US005153370A

United States Patent [19]

Hardt

[11] Patent Number: 5,153,370

[45] Date of Patent: Oct. 6, 1992

[54] SAFE AND ARM DEVICE WITH VARIABLE ARMING DELAY BY LIQUID EXPLOSIVE

[75] Inventor: Lee R. Hardt, Ridgecrest, Calif.

[73] Assignee: The United States of America as represented by the Secretary of the Navy, Washington, D.C.

[21] Appl. No.: 756,265

[22] Filed: Aug. 30, 1991

Related U.S. Application Data

[62] Division of Ser. No. 591,209, Oct. 1, 1990.

[51] Int. Cl.[5] ..... F42C 15/24; F42C 15/285

[52] U.S. Cl. ..... 102/250; 102/277.1

[58] Field of Search ..... 102/223, 228, 222, 277.1, 102/247, 248, 250

[56] References Cited

U.S. PATENT DOCUMENTS

| | | | |
|---|---|---|---|
| 1,336,391 | 4/1920 | Semple | 102/247 |
| 3,602,141 | 8/1971 | Sutter et al. | 102/305 |
| 3,608,493 | 9/1971 | Aske | 102/250 |
| 3,881,419 | 5/1975 | Bea | 102/222 |
| 4,241,660 | 12/1980 | Donovan | 102/473 |

FOREIGN PATENT DOCUMENTS

| | | | |
|---|---|---|---|
| 3313713 | 10/1984 | Fed. Rep. of Germany | 102/247 |

*Primary Examiner*—Stephen M. Johnson

*Attorney, Agent, or Firm*—Stephen J. Church; Melvin J. Sliwka; John L. Forrest, Jr.

[57] ABSTRACT

A safe and arm device, which has an explosive train interrupted by a void to establish a safe condition, has the void filled with a liquid explosive to establish an armed condition. The void may be in a manometer-like device in which the liquid explosive is motivated by fluid pressure corresponding to free-fall or other velocities. Premature arming may be prevented by forming the explosive liquid by melting a solid explosive with heat generated electrically. A selectively variable arming time delay may be provided by a variable orifice controlling the flow of the liquid explosive or by varying the temperature of the liquid to select its viscosity.

6 Claims, 3 Drawing Sheets

SAFE AND ARM DEVICE WITH VARIABLE ARMING DELAY BY LIQUID EXPLOSIVE

CROSS-REFERENCE TO RELATED APPLICATION

This application is a division of application Ser. No. 07/591,209 filed Oct. 1, 1990.

BACKGROUND OF THE INVENTION

1. Field of the Invention

The present invention pertains to the field of ammunition and explosives. More particularly, the invention pertains to the field of arming devices of the blocking or interrupting type which may be operated by fluid pressure or inertia.

2. Description of the Related Art

Safe and arm devices typically have an explosive train including an element which is displaced from the train to place the device in a safe condition and which is inserted into the train to place the device in an armed condition. The element is, typically, a pellet of explosive mounted in a rotor or slide which is motivated, when conditions are appropriate for arming, to carry the pellet into the train. Since detonation of an explosive typically requires that it be subjected to a shock wave, as from a previously detonated explosive in an explosive train, it is known to provide a safe condition by providing a void in the train, the void being filled by some inert, but shock wave transmitting, material to establish an armed condition.

For safety, economy in construction, and reliability, it is highly desirable that insertion of an element for arming be motivated directly by an environmental condition only existing when arming is required. A typical example is the motivation of a element, such as an abovementioned slide or rotor, by the inertia of the element when a projectile is fired from a gun. However, direct motivation of such an element may not be practical when the environmental condition, such as mild acceleration or a relatively slight pressure change, provides relatively limited force. Although such a lack of force may be overcome by using low friction elements, by using energy stored in springs or batteries, by using electronic sensors and amplifiers, or by using very large inertia or pressure responsive elements, the resulting bulk, expense, and fragility are highly undesirable. Also, it is evident that a safe and arm device actuated by a relatively small environmental change or by stored energy is impracticably dangerous unless stringent precautions are taken to prevent premature arming when a similar change occurs during shipping, handling, or as a result of accident. Even where relatively large environmental forces are available, as from ram air in an air launched missile, safe and arm devices typically sense conditions for arming and assume an armed condition using mechanical or electromechanical devices which are relatively complex and, therefore, are expensive and unreliable and require further complexities to prevent improper arming.

It is known in an underwater ordnance device such as a mine to have an explosive train interrupted by a void and to arm the device by filling the void with water for transmission of a detonation shock wave, the filling typically occurring by gravity when water soluble plugs on the device exterior dissolve subsequent to placement of the device in its intended environment. In such underwater devices, it is apparent that large explosive train elements may be provided to generate a shock wave effective to initiate further detonation despite attenuation by the water, that a substantial length of time is available for dissolving the plugs and filling the void, and that this delay and the use of plugs soluble only in the intended environment provide stringent safety precautions. It is also apparent that such an arrangement using an inert liquid, while practical for underwater ordnance, is impractical in a safe and arm device for use, for example in an air launched missile, where bulk and weight must be minimized and arming must occur in a fraction of a second, or where, as in free-fall ordnance, there is no environmental condition change as substantial and enduring as that from air to undersea emplacement.

SUMMARY OF THE INVENTION

A safe and arm device, which has an explosive train interrupted by a void to establish a safe condition, has the void filled with a liquid explosive to establish an armed condition. The void may be in a manometer-like device wherein the liquid is motivated to move into the void by fluid pressure which may correspond to a predetermined aerial velocity ranging from free-fall to supersonic. Premature arming may be prevented by use of an explosive liquid formed by melting a solid explosive, the melting being by heat generated electrically or pyrotechnically or derived from ram air or from a rocket motor or other propulsion system. An arming delay may be provided by an orifice or by a viscosity determining the flow of the explosive liquid, and this delay may be altered by varying the orifice or varying the temperature of the liquid explosive to change its viscosity.

OBJECTS OF THE PRESENT INVENTION

An object of the present invention is to provide a safe and arm device which may be motivated to an armed condition directly and reliably by relatively slight changes in environmental conditions and which reliably remains in a safe condition until other conditions for arming are satisfied.

Another object is to provide such a device which may be prevented from establishing its armed condition by any one or more of variety of predetermined conditions involving pressure, inertia, or temperature and wherein an arming delay is selectively variable.

Still another object is to provide a safe and arm device which has the above advantages and yet is simple, inexpensive, rugged, and compact.

BRIEF DESCRIPTION OF THE DRAWINGS

Other objects, advantages, and novel features of the present invention will become apparent from the following detailed description when considered with the accompanying drawings in which.

DETAILED DESCRIPTIONS

In the following descriptions, it is to be understood that the described embodiments of the present invention are only portions of safe and arm devices which may have a variety of constructions providing electrical, electronic, mechanical and/or chemical safe and arm arrangements in addition to those of the present invention and that these additional arrangements and those of the present invention may be used in many operating environments including, by way of example only, air or surface launched missiles, bombs, projectiles, and mines with arming and final actuation by a variety of presently well-known or later developed devices adapted to the particular environment. Therefore, the following descriptions and accompanying drawings depict embodiments of the present invention and associated elements of representative operating environments diagrammatically with the scales, relative positions, and details of the depicted elements selected to show the present invention and without mounting and connecting elements which may vary with the particular operating environment and which may of any suitable construction selected by one skilled in the art of ammunition and explosives.

Operating Environment

Figure 1:
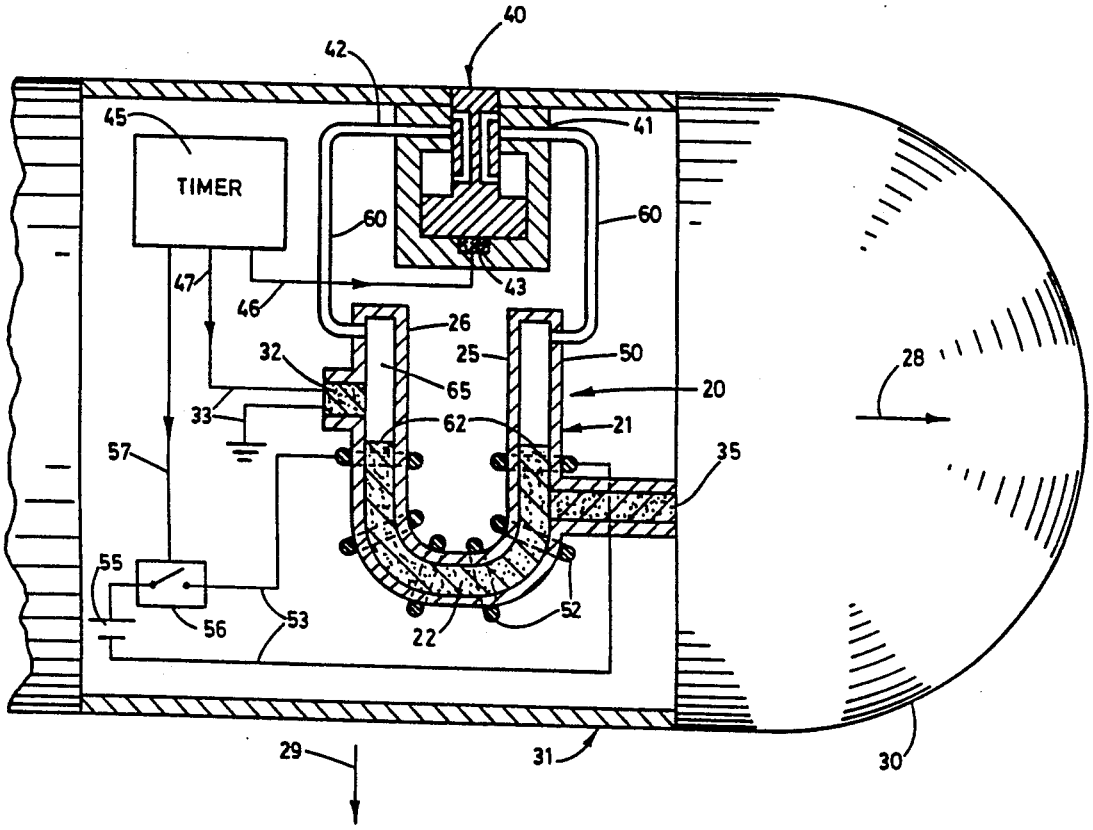
FIG. 1 is a diagram of a first safe and arm device which is in a representative operating environment for the present invention and is characterized by having a manometer, this device being shown in a safe condition.

FIG. 1 shows a safe and arm device 20 which is a representative operating environment of the present invention and is characterized by having a manometer 21 containing a predetermined quantity of an explosive 22. Device 20 is depicted in a representative operating environment of a portion of a missile or the like vehicle. Manometer 21 is a U-tube manometer having opposite arms 25 and 26 subjected to a differential air pressure. However, "manometer" is used in the present application in the general sense of a device having a tube or other enclosure wherein a liquid is displaced by fluid pressure, the displacement being proportional to the density of the liquid and to an acceleration, as from gravity, centrifugal force, or a propulsion system, to which the manometer is subjected. The FIG. 1 missile is adapted to move in air in the direction indicated by arrow 28 while gravity or a comparable centrifugal force acts in the direction indicated by arrow 29.

The FIG. 1 missile portion has a warhead section 30 having an explosive charge, not specifically shown, to be exploded at an appropriate time by a fuze section 31 which includes device 20 and a detonator 32 juxtapositioned to manometer arm 25 and initiated electrically through electrical leads 33 to provide a detonation or shock wave to device 20 for transmission or blocking by the device. A transmitted such wave is provided to warhead 30 from manometer arm 26 through an explosive lead 35 so that manometer 21, detonator 32, and lead 35 are an explosive train. Explosive 22, lead 35, and the charge of warhead section 30 are each composed of a substance which will not explode, that is decompose violently in a detonation wave, unless initiated by another detonation wave which has not been attenuated by passage through a "void", which for purposes of the present application may be the atmosphere or other fluid.

Explosive 22 may be a liquid under all normal conditions, but is preferably any suitable substance having a solid state which can be liquified, as by solvents or heating, to provide an explosive liquid. In particular, explosive 22 may be a substance having a phase which is solid at ambient temperatures and which melts at a predetermined temperature to a liquid phase by the application of heat. It is believed that trinitrotoluene (TNT) which melts at about 80° C. (176° F.), is such a substance well suited for the practice of the present invention.

Fuze section 31 includes a well-known, extensible probe 40 which is depicted in a retracted condition in FIG. 1. Probe 40 has connections 41 and 42 providing a differential pressure corresponding to missile velocity in direction 28. Probe 40 is motivated to an extended position depicted in FIG. 2 by a squib 43. Fuze section 30 includes any suitable timer 45 controlling a representative sequence of events, which bring the missile from an initial safe condition through an armed condition to detonation of warhead 30 and which includes firing squib 43 by a connection 46 and may include initiating detonator 32 by a connection 47. A detonator corresponding to detonator 32 may, of course, be initiated by target impact or proximity or for other reason than elapsed time not relevant to the subject invention.

Manometer 20 with its arms 25 and 26 has a tubular wall 50 which is constructed of any suitable heat conducting material and which is wound exteriorly with an electrical heating element 52 for the quantity of explosive 22. Element 52 is connected through conductors 53 to an electrical energy source 55 and is selectively energizable therefrom, as by a switch 56 controlled by a connection 57 from timer 45, to heat explosive 22 in its solid phase and provide an explosive liquid by melting.

Figure 2:
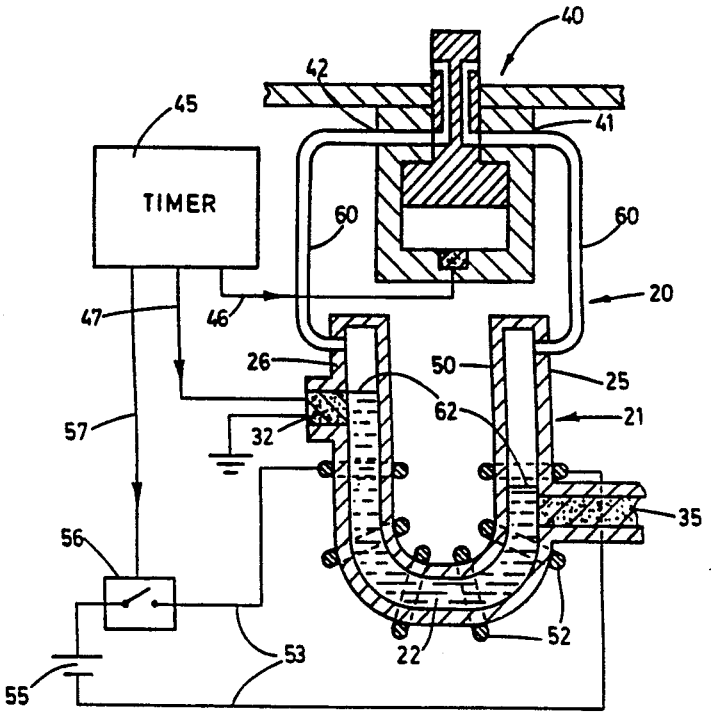
FIG. 2 is a diagram showing the device of FIG. 1 in an armed condition.

Arms 25 and 26 are connected to probe connections 41 and 42 by any suitable conduits 60 so that the differential pressure or pressurized fluid due to a predetermined velocity in direction 28 urges movement of a liquid within wall 50 in opposition to force 29 from a safe position, which is that of explosive 22 depicted in FIG. 1, to an armed position which is that of explosive 22 depicted in FIG. 2 wherein certain elements of the operating environment are omitted for simplicity. Such movement is upwardly in arm 26 and downwardly in arm 25 from the safe position wherein the surfaces 62 of the explosive are at the same level in arms 25 and 26. The quantity of explosive 22 and the respective positions of detonator 32 and lead 35 along arms 25 and 26 are selected so that detonator 32 is disposed along arm 25 at a location thereon which, in the safe condition, is above surface 62 in arm 25 and which, in the armed condition, is below this surface and are selected so that lead 35 communicates with arm 26 at a location which is below surface 62 in arm 26 in both the safe and the armed conditions. It is apparent that tubular wall 50 of manometer 20 defines an enclosure for storing the quantity of explosive 22 in its solid state with the explosive substantially occupying the region in which it is depicted in FIG. 1. It is also apparent that, with explosive 22 in its FIG. 1 safe condition, wall 50 defines within itself a predetermined void region indicated by numeral 65 and disposed where detonator 32 adjoins wall 50. It is evident that region 65 is interposed in the explosive train formed by detonator 32, manometer 20, and explosive lead 35 so as to block passage of a detonation wave from the detonator through the manometer to warhead section 30 and that wall 50 stores the predetermined quantity of explosive 22 at a location spaced from region 65.

At an appropriate time in the operation of a missile having fuze 30 with explosive 22 below its melting temperature and disposed outside of region 65, timer 45 energizes heater 52 which raises the temperature of explosive 22 above its melting temperature to form an explosive liquid, such as the liquid phase of an explosive such as TNT. Timer 45 also fires squib 43 to extend probe 40 and provide to manometer 20 and the liquid explosive therein the above-mentioned differential air pressure corresponding to the missile velocity. When the missile attains a predetermined velocity, which is determined by the relative length of arms 25 and 26, density of the explosive liquid, and the force acting in direction 29 and is a precondition for arming of fuze 30, the differential pressure urges the explosive liquid to be conducted by wall 50 from where explosive 22 is stored, as shown in FIG. 1, toward and into region 65 to establish the armed condition of the explosive train shown in FIG. 2. In this armed condition a detonation wave initiated by detonator 32 is propagated into the explosive liquid which then detonates, thereby amplifying and further propagating the detonation wave through manometer 20 to lead 35 and warhead 30.

It is apparent that device 20 cannot establish its armed condition until explosive 20 is melted by heating element 52. It is also apparent that a device such as manometer 21 may be constructed so that, after melting of an explosive therein, an armed condition may be established by relatively small differential pressure since movement of the explosive liquid in a conduit such as tubular wall 50 is relatively frictionless. Such an armed condition is also established reliably since the differential pressure, which itself is the environmental condition on which arming is to occur, motivates the explosive liquid directly without the interposition of mechanical or electromechanical devices which may fail by not establishing the armed condition when appropriate or may fail dangerously by premature establishment of the armed condition.

First Embodiment

In certain applications of the subject invention it may be desirable to selectively delay establishment of an armed condition from a safe condition after other desired conditions for arming are present. Such a selective delay is provided in a safe and arm device embodying the present invention and shown in FIG. 3. This embodiment is similar to that of FIGS. 1 and 2 and corresponding elements in these three figures have the same numerals, FIG. 3 being similar to the simplified FIG. 2 but depicting the explosive liquid 22 in its safe condition as in FIG. 1.

Figure 3:
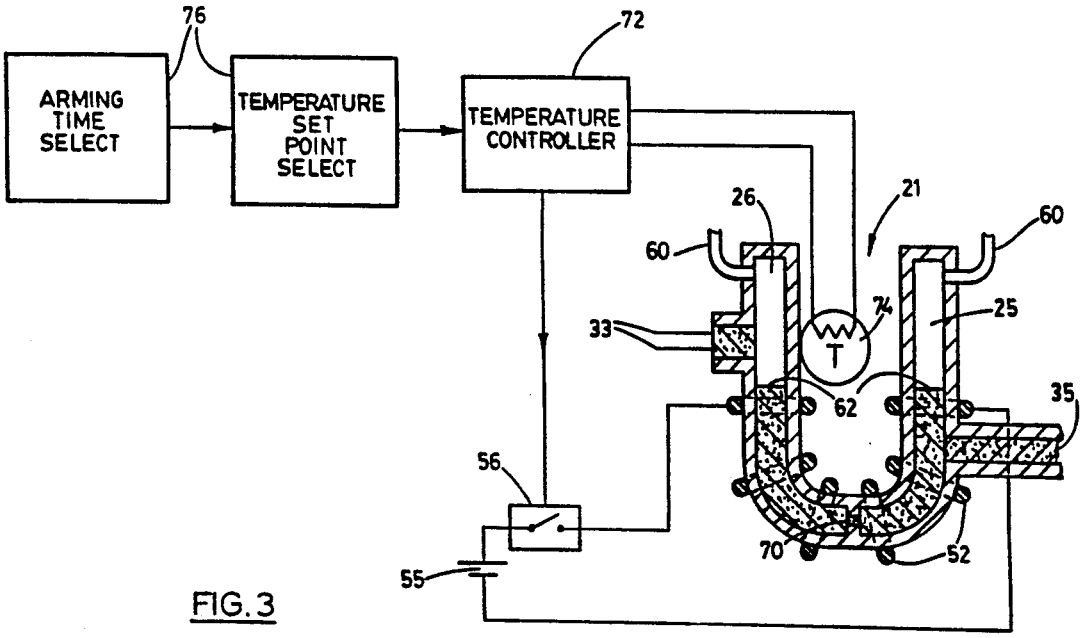
FIG. 3 is a diagram of a safe and arm device embodying the present invention and similar to the FIG. 1 device, the FIG. 3 device having a first set of additional elements for selectively delaying the armed condition.

The FIG. 3 device has an orifice 70 of a predetermined size disposed in arm 26 between surface 62 of explosive 22 and lead 35 so that the viscosity of the liquified explosive delays movement thereof into region 65 and the armed condition. The viscosity of the liquid explosive varies with temperature so that the time for this movement may be selected by selecting the liquid explosive temperature by controlling switch 56 by any suitable temperature controller 72 responsive, as through a sensor 74 at tubular wall 50 adjacent to orifice 70, to the liquid explosive temperature and responsive to a set point for this temperature provided in any suitable manner indicated by elements identified by numeral 76.

Second Embodiment

Figure 4:
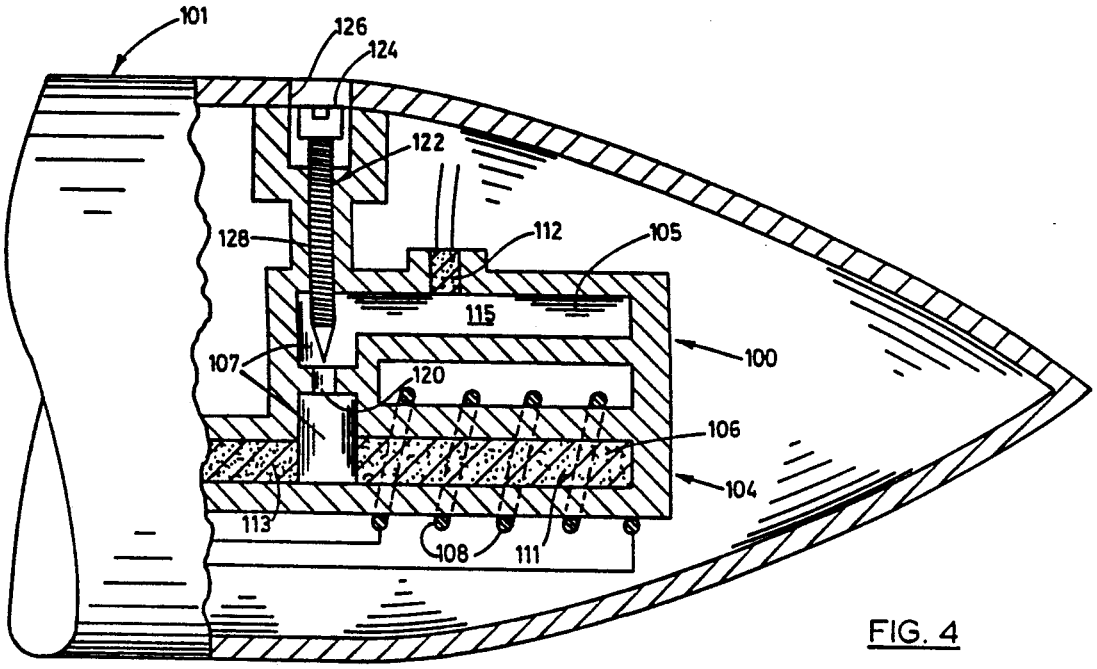
FIG. 4 is a diagram of another safe and arm device embodying the present invention and additionally characterized by arming on acceleration, the FIG. 4 device having a second set of additional elements for selectively delaying the armed condition and being shown in a safe condition and in an operating environment somewhat different form that of FIGS. 1–3.
Figure 5:
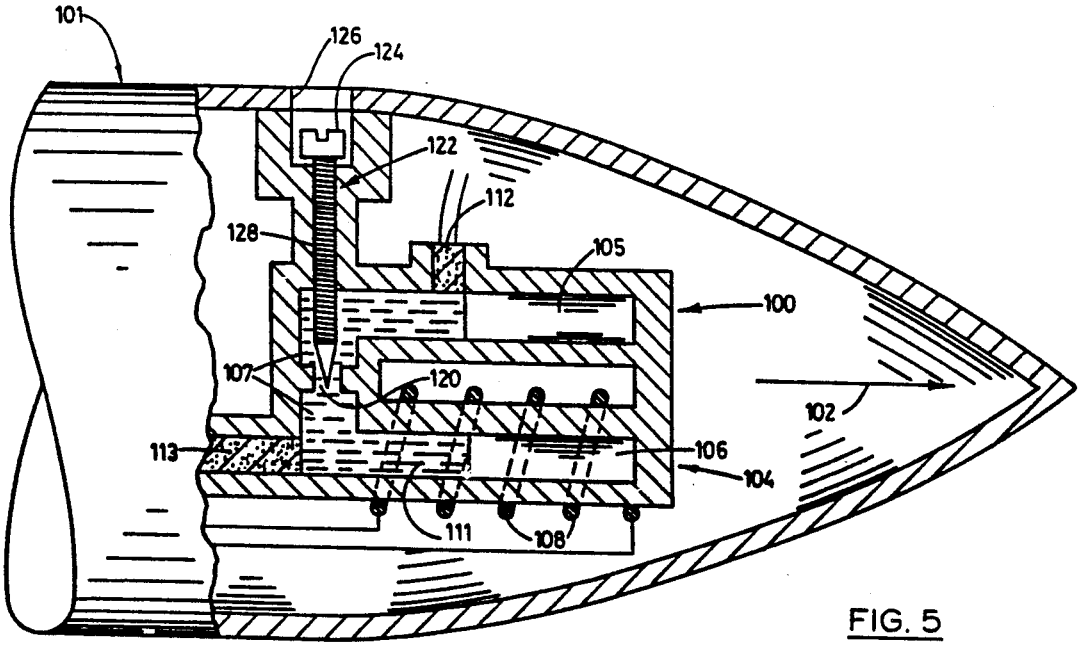
FIG. 5 is a diagram showing the device of FIG. 4 in an armed condition.

Such a selective delay in establishing an armed condition from a safe condition is also provided by a safe and arm device 100 embodying the present invention and shown in FIGS. 4 and 5 in a representative operating environment, such as a projectile portion 101 having an acceleration in a direction indicated by numeral 102 in FIG. 5. Device 100 has a manometer body 104 with a pair of parallel passages 105 and 106 corresponding generally to FIG. 1 arms 25 and 26. These passages extend in the direction of acceleration 28 and are joined at their ends opposite the direction of acceleration by a connecting passage 107. Body 104 is provided with a heater 108 corresponding to heater 52 for liquefying a quantity of explosive 111 corresponding to explosive 22 and stored in a solid state in arm 106. A detonator 112, which corresponds to detonator 32, is disposed at arm 105 and an explosive lead 113, which corresponds to lead 35, extends from passage 106 to an explosive charge, not shown. Explosive 111 is stored in passage 106 as shown in FIG. 4 so that a void 115, corresponding to void 65, exists in passage 105 at detonator 112 and blocks transmission of a detonation wave from the detonator to lead 113 and establishes a safe condition of device 100. However, when explosive 111 is melted by heater 108 and acceleration is occurring in direction 102, the inertia of the explosive liquid urges the liquid toward void 115 to occupy the same length of both passages 105 and 106 for transmission of a detonation wave from detonator 112 to lead 113, thereby establishing an armed condition of device 100.

Device 100 has an orifice 120 disposed in passage 107 through which liquified explosive 111 flows from passage 106 toward void 115 and has a needle valve element 122 extending through body 104 into the orifice and moveable therein to vary the effective size of the orifice and select a predetermined time delay for conduction of liquified explosive from passage 106. Element 122 may be actuated in any suitable manner, as by providing the element with a head 124 disposed for rotational engagement through an opening 126 in projectile 101 and with screwthreads 128 engaging body 104.

It is evident from the preceding paragraph and from FIGS. 4 and 5 that orifice 120 and needle valve element 122 function as a variable orifice or control device operable, when safe and arm device 100 is in an assembled condition shown in these figures, to vary the flow of explosive liquid 111 from passage 106 toward void 115. It is also evident that head 124 is a control device operable when device 100 is in such assembled condition for adjusting such variable orifice to select a desired time elapsing subsequent to said safe condition and during conduction of the explosive liquid from passage 106 toward void 115 to establish the armed condition of device 100.

It is apparent that device 102 cannot establish its armed condition until explosive 111 is melted by heating element 108 and that manometer body 104 may be constructed so that, after melting of the explosive, the armed condition may be established by a relatively small acceleration in direction 102. It is also apparent that a device similar to device 100 may be constructed so as to arm on relatively slight deceleration as occurs at release of a unpowered bomb.

Obviously, many modifications and variations of the present invention are possible in light of the above teachings. It is, therefore, to be understood that the invention may be practiced within the scope of the following claims other than as specifically described herein.

What is claimed is:

1. A safe and arm device having an assembled condition and comprising:

an explosive train having a predetermined region, said region being substantially void to establish a safe condition of said train by interrupting progress of an explosion along the train;

an explosive liquid;

storage means spaced from said region for storing said explosive liquid;

conduit means extending between said storage means and said region;

means for urging said explosive liquid to flow from said storage means through said conduit means into said region to establish an armed condition of said train;

first control means operable in said assembled condition for varying a flow of said explosive liquid through said conduit means; and second control means operable in said assembled condition for adjusting said first control means to select a desired time subsequent to said safe condition and elapsing during conduction of said explosive liquid from said storage means to said region to establish said armed condition.

2. The safe and arm device of claim 1 wherein:

said first control means comprises a variable orifice disposed in said conduit means; and said second control means adjusts said orifice to select said time.

3. A safe and arm device comprising:

an explosive train having a predetermined region, said region being substantially void to establish a safe condition of said train by interrupting progress of an explosion along the train;

an explosive liquid, wherein the viscosity of said explosive liquid varies with temperature;

storage means spaced from said region for storing said explosive liquid;

conduit means extending between said storage means and said region;

means for urging said explosive liquid to flow from said storage means through said conduit means into said region to establish an armed condition of said train; and flow control means for selecting a flow of said explosive liquid through said conduit means subsequent to said safe condition to vary a time elapsing during conduction of said explosive liquid from said storage means to said region to establish said armed condition, and for controlling the temperature of said explosive liquid to select a temperature of said explosive liquid corresponding to a predetermined viscosity thereof such that said time elapses during conduction of said explosive liquid from said storage means to said region.

4. The safe and arm device of claim 3:

wherein the device includes a quantity of a substance having a solid state liquefied to provide said explosive liquid, said substance being stored in said solid state and in said storage means; and wherein the device further comprises liquefying means for liquefying said quantity of said substance in said solid state into said explosive liquid.

5. The safe and arm device of claim 3:

wherein the device includes a quantity of a substance having a solid state meltable by heating to provide said explosive liquid, said substance being stored in said storage means and in said solid state;

wherein the device further comprises controllable heating means for melting said quantity of said substance to provide said explosive liquid; and wherein said flow control means controls said heating means to select said temperature of said explosive liquid corresponding to said predetermined viscosity thereof.

6. The safe and arm device of claim 5 wherein said substance is trinitrotoluene.

* * * * *